US009260117B2

(12) United States Patent
Vande Sande

(10) Patent No.: US 9,260,117 B2
(45) Date of Patent: Feb. 16, 2016

(54) COMPOSITE ROOF CONVERSION

(71) Applicant: Jerry W. Vande Sande, Dallas, TX (US)

(72) Inventor: Jerry W. Vande Sande, Dallas, TX (US)

(73) Assignee: Trinity Industries, Inc., Dallas, TX (US)

( * ) Notice: Subject to any disclaimer, the term of this patent is extended or adjusted under 35 U.S.C. 154(b) by 0 days.

(21) Appl. No.: 13/859,451

(22) Filed: Apr. 9, 2013

(65) Prior Publication Data

US 2013/0269265 A1 Oct. 17, 2013

Related U.S. Application Data

(60) Provisional application No. 61/623,234, filed on Apr. 12, 2012.

(51) Int. Cl.
*B61D 17/12* (2006.01)
*B61D 3/00* (2006.01)
*B61D 49/00* (2006.01)

(52) U.S. Cl.
CPC *B61D 3/00* (2013.01); *B61D 17/12* (2013.01); *B61D 49/00* (2013.01)

(58) Field of Classification Search
CPC ..... B61D 3/00; B61D 9/00; B61D 17/12
USPC ..... 52/45, 48
See application file for complete search history.

(56) References Cited

U.S. PATENT DOCUMENTS

| | | | | | |
|---|---|---|---|---|---|
| 1,674,463 | A * | 6/1928 | Bonsall | 52/17 |
| 2,083,633 | A * | 6/1937 | Brackett | 118/323 |
| 2,358,405 | A * | 9/1944 | Lohse et al. | 105/404 |
| 2,519,079 | A * | 8/1950 | Shaver | 52/51 |
| 3,027,187 | A * | 3/1962 | Rivers | 296/186.1 |
| 3,035,161 | A * | 5/1962 | Kalt | 362/479 |
| 3,820,476 | A * | 6/1974 | Harter et al. | 105/404 |
| 4,233,795 | A * | 11/1980 | Snyder et al. | 52/514 |
| 5,916,093 | A * | 6/1999 | Fecko et al. | 52/17 |
| 5,988,074 | A * | 11/1999 | Thoman | 105/404 |
| 7,438,001 | B2 * | 10/2008 | Nakamura et al. | 105/396 |
| 2002/0157565 | A1 * | 10/2002 | Norton et al. | 105/404 |
| 2007/0234927 | A1 * | 10/2007 | Beers et al. | 105/404 |
| 2010/0102574 | A1 * | 4/2010 | Brewster et al. | 292/229 |
| 2013/0192488 | A1 * | 8/2013 | Low et al. | 105/377.05 |

FOREIGN PATENT DOCUMENTS

DE 10008946 C1 * 10/2001

* cited by examiner

*Primary Examiner* — Christine T Cajilig
(74) *Attorney, Agent, or Firm* — Baker Botts L.L.P.

(57) ABSTRACT

A method comprising removing a roof from a railcar, the railcar comprising a plurality of top chords, coupling an outer portion of a replacement roof to one or more of the plurality of top chords, the outer portion comprising a frame and a first plurality of panels, and coupling an inner portion of the replacement roof to the frame of the outer portion of the replacement roof after coupling the outer portion to one or more of the plurality of top chords, the inner portion comprising a second plurality of panels.

11 Claims, 14 Drawing Sheets

COMPOSITE ROOF CONVERSION

TECHNICAL FIELD

This disclosure relates generally to converting a roof of a railcar.

BACKGROUND

Earlier designed railcars employed a one piece composite roof to help reduce the weight of those cars, thus increasing the cars' capacity. When these roofs were damaged or as they degraded over time, options were limited for their repair or replacement. Patch repairs for these roofs are expensive and require special materials and processes. Replacing the entire roof in kind is cost prohibitive due to the high cost of making a new mold.

SUMMARY

The teachings of the present disclosure relate to a method for converting a roof of a railcar. In accordance with one embodiment, a method is provided for removing a roof from a railcar, the railcar comprising a plurality of top chords, coupling an outer portion of a replacement roof to one or more of the plurality of top chords, the outer portion comprising a frame and a first plurality of panels, and coupling an inner portion of the replacement roof to the frame of the outer portion of the replacement roof after coupling the outer portion to one or more of the plurality of top chords, the inner portion comprising a second plurality of panels.

Technical advantages of particular embodiments may include providing a long term and cost effective solution to continuously having to repair damaged composite roofs. An additional technical advantage of certain embodiments is a roof that may be easier to repair. A technical advantage of various embodiments is a roof that provides the structural integrity and repair-ability of steel. An additional technical advantage of particular embodiments is the application to earlier generation railcars of a roof similar in design to roofs used on later generation railcars. Another technical advantage of certain embodiments is the ability to fabricate the roof on the car body without requiring special fixturing, molds, or handling. These advantages may result in economic and logistical improvements for railcar manufacturers and/or operators.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of particular embodiments will be apparent from the detailed description taken in conjunction with the accompanying drawings in which.

DETAILED DESCRIPTION

Particular embodiments disclose a method of converting a composite roof of a railcar. Some or all embodiments disclose removing a composite roof and replacing it with a newly constructed roof, built on the existing railcar. The new roof may provide similar, additional, or different capabilities as the previous, composite roof. For example, in certain embodiments, the railcar may be a refrigerated railcar and the newly constructed roof may provide a similar level of performance with respect to maintaining levels of refrigeration. In particular embodiments, the newly constructed roof may be built on a new railcar.

The construction process, in various embodiments, may include applying steel beams across the width of the railcar, applying corrugated steel panels to create an exterior portion of the roof, and applying materials, including insulation, interior panels, and plenum panels, to create an interior portion of the roof.

Figure 1:
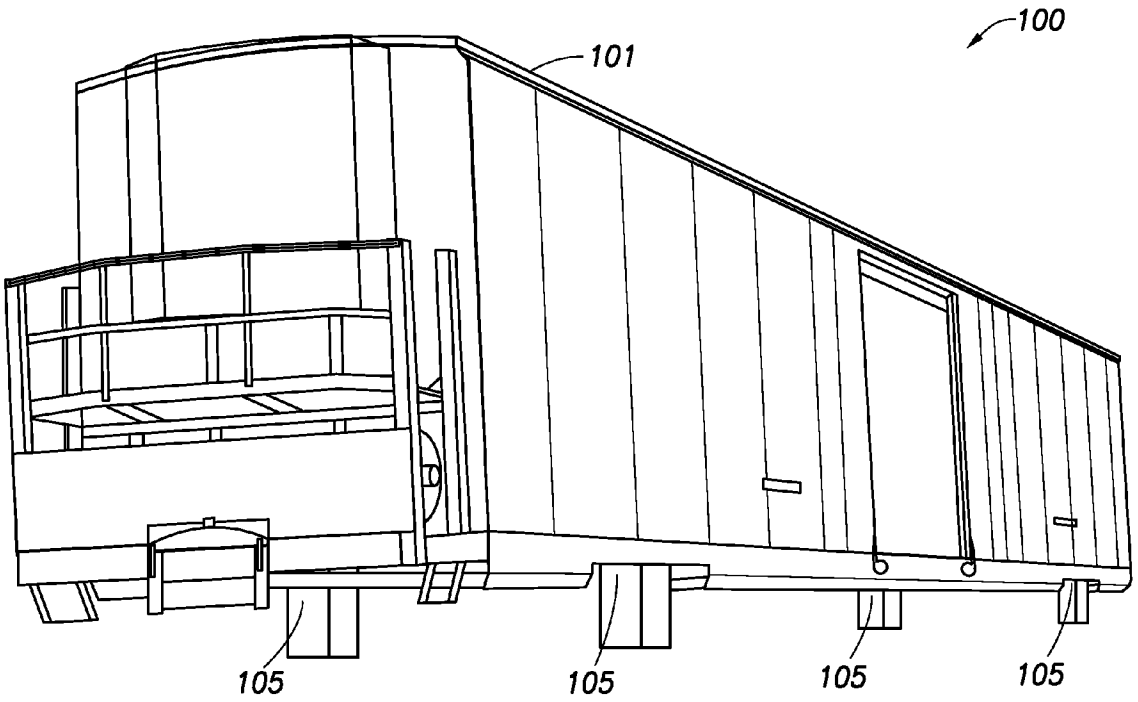
FIG. 1 illustrates a railcar with a roof in accordance with particular embodiments.

FIG. 1 illustrates a railcar with a roof in accordance with particular embodiments. Railcar 100 includes an existing roof 101 and jacking pads 105. In some embodiments, railcar 100 may be a refrigerated railcar.

Roof 101 includes a composite material and may be removed from railcar 100. The process of removing roof 101 may include several preliminary considerations. First, it may be useful to conduct all operations on a solid track that is appropriately level and to utilize chocks so the railcar cannot move. In order to remove roof 101, it may be helpful to block each corner of railcar 100 at jacking pads 105 and to level the body of railcar 100 to ensure that the railcar body is square. It may be useful to establish corner elevations using an electronic level. In particular embodiments, one or more trucks or car wheel assemblies may remain under the body of railcar 100 for safety or logistical reasons.

Adhering to these considerations may facilitate easier removal of the existing railcar roof and may also prove useful during several steps of the construction process, similar to the steps described in conjunction with FIGS. 3 through 10.

Figure 2:
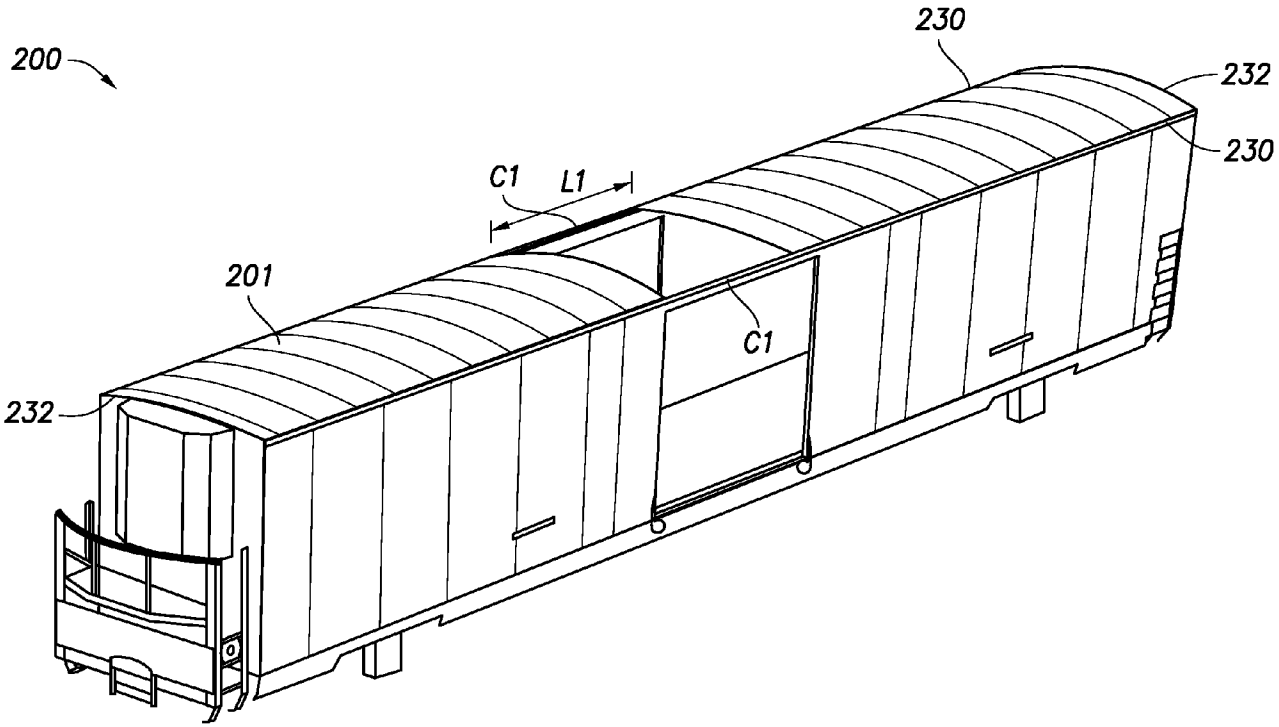
FIG. 2 illustrates a railcar with a portion of its roof removed in accordance with particular embodiments.

FIG. 2 illustrates a railcar with a portion of its roof removed in accordance with particular embodiments. Railcar 200 includes roof 201, longitudinal top chords 230, and end chords 232. In certain embodiments, roof 201 may be a one-piece composite roof.

The process of removing roof 201 may include removing existing interior components, for example, plenum panels, plenum transition components, and interior trim pieces that interface with roof 201. In certain embodiments, the plenum panels may be particular Thermo King plenum panels or other panels. In particular embodiments, interior trim pieces may be glued onto the railcar, screwed into the car, or both. These items may include trim pieces at the sidewall, end wall, and/or roof interface.

Certain embodiments may include various sensors, for example a door opener sensor, which may be disconnected and secured. Similarly, various electrical and mechanical couplings, including, for example, any thermal couplings or couplings related to refrigeration systems, should be disconnected and secured.

Figure 9:
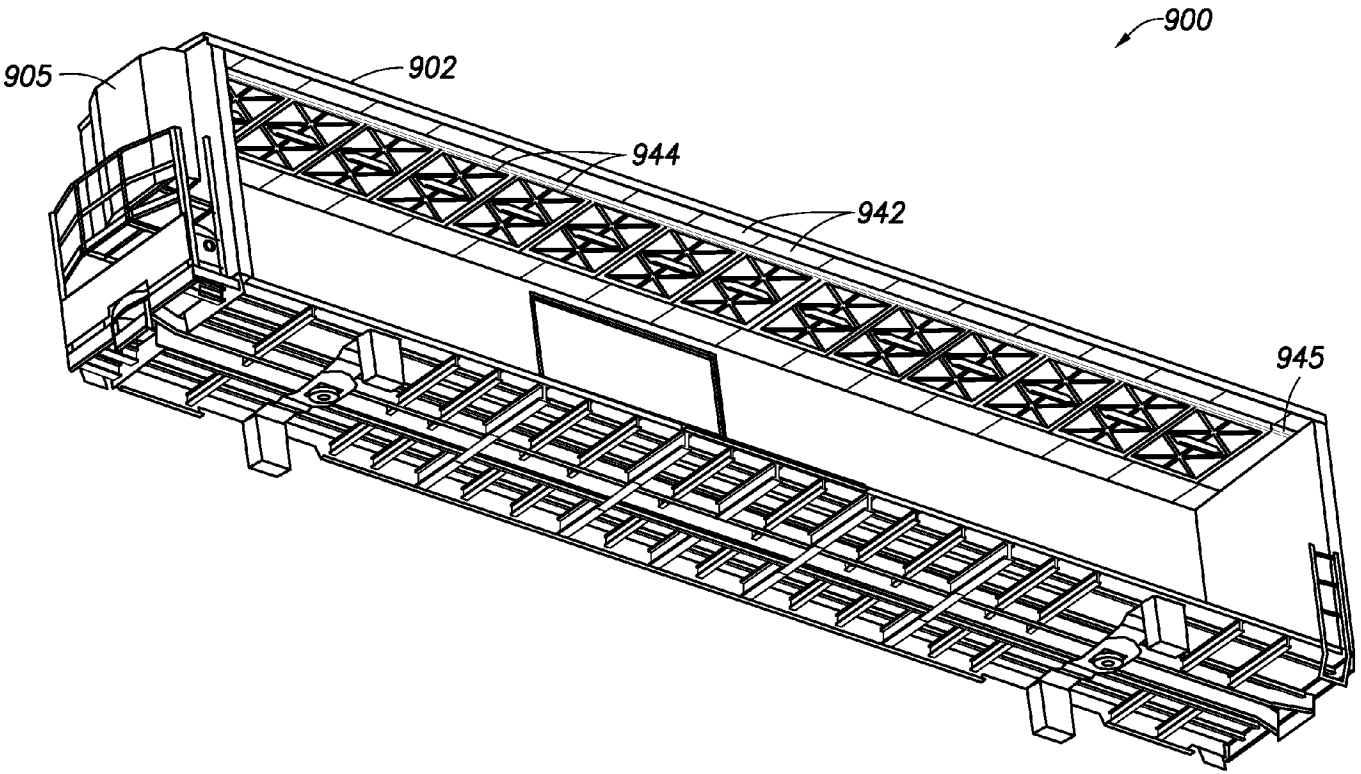
FIG. 9 illustrates a portion of a railcar in accordance with particular embodiments.

In various embodiments, some, all, or none of these components may be reused in constructing a new roof, similar to components described in conjunction with FIG. 9. Thus, it may be helpful to mark each piece before removal to identify its location. Reusing some or all of these parts may reduce various costs associated with constructing a new roof.

The process of removing roof 201 may also entail removing perimeter bolts and breaking a glue seal securing roof 201 to railcar 200. It may be useful to begin breaking the glue seal at one corner of the railcar from both the exterior and interior of the car. In various embodiments, the roof may be glued to the railcar around the railcar's perimeter, bolted to the railcar around the railcar's perimeter, or both. In various embodiments, it may be helpful to break the glue seal using a pry bar or other equivalent tool. In particular embodiments, the roof may be able to be removed in one piece. In certain embodiments, the roof may require removal in several sections.

In certain embodiments, roof 201 may be removed in sections. In these embodiments, longitudinal center points C1 are marked along the length of the roof. Each longitudinal center point C1 is located at or approximately at the center point along the length of longitudinal top chords 230 and roof 201. The line that transverses roof 201 from one longitudinal center point C1 to the other longitudinal center point C1 is the center line of roof 201. From this center line, 7'-6" should be measured toward each end of railcar 200. A center section of roof 201 with a length L1 may be removed as illustrated by cutting along these lines, which are 7'-6" from the center line. L1 is approximately 15'. As described above, roof 201 may be both bolted and glued to longitudinal top chords 230. Thus, once a section of roof 201 is cut, the edges of roof 201 must be unbolted and the glue seal must be broken along lengths L1 of top chords 230. It may be necessary to work from both the outside and the inside of railcar 201 to accomplish an effective removal of a section of roof 201 and a removal that does not cut or damage longitudinal top chords 230. By removing roof 201 in sections, the remaining portions of the composite roof may provide support to longitudinal top chords 230. In various embodiments, the remaining portions of roof 201 may help hold longitudinal top chords 230 and end chords 232 square and straight. Once roof stiffeners and corrugated roof sheet panels are positioned within the removed section, as described in conjunction with FIGS. 3A, 3B, 4A, and 4B, a second 15' section may be removed as described herein and this same process may be repeated until roof 201 has been fully removed.

After roof 201 is removed or after a section of roof 201 is removed, the exposed longitudinal top chords 230 or exposed sections of top chords 230, respectively, must be cleaned and inspected in preparation for welding. Exposed end chords 232 may be similarly cleaned.

In various embodiments, cleaning may comprise removing glue residue by careful scraping, followed by a solvent wipe. This solvent may be citrus terpene or N-methyl pyrolidone (NMP) or any suitable solvent. Preferably, the solvent should be used sparingly and should not be dripped or spilled into the interior of the railcar.

In particular embodiments, residual glue may be removed by grinding, which may also be followed by a solvent wipe. Preferably, residual glue is fully removed from the top surface of longitudinal top chords 230. Residual glue on the upper radius or on the interior, vertical face of longitudinal top chords 230 may also be removed, especially in areas where beams or roof stiffeners will interface and be welded to longitudinal top chords 230 as will be described in conjunction with FIGS. 3A and 3B.

In particular embodiments, once the top chord is cleaned, it may be appropriate to apply a light coat of a weldable primer to any areas subject to rust. These steps, individually or together, may improve joints welded with the railcar top chord and may, therefore, increase the structural integrity of a newly constructed roof.

Figure 3A:
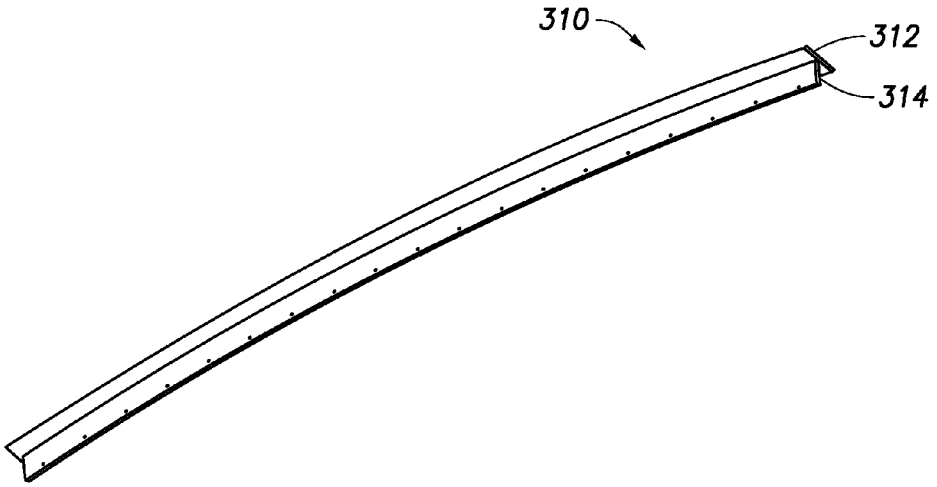
FIGS. 3A and 3B illustrates a roof stiffener that may be used in accordance with particular embodiments.
Figure 3B:
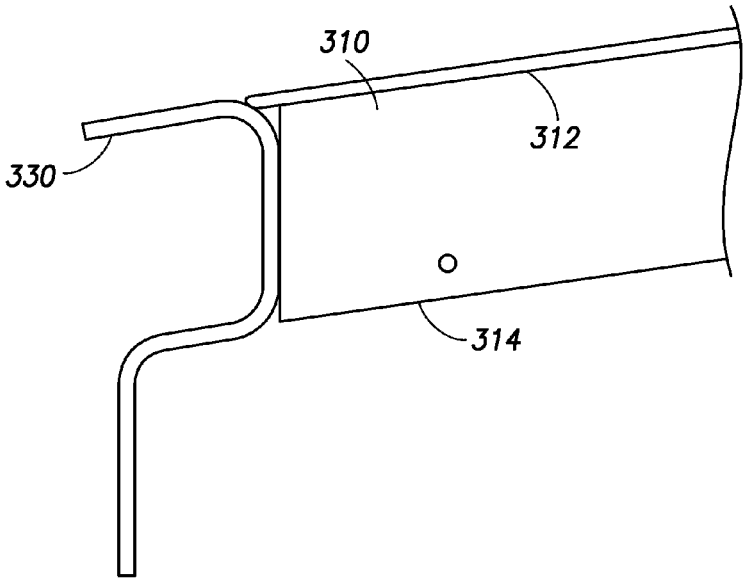

FIGS. 3A and 3B illustrates a roof stiffener that may be used in accordance with particular embodiments. FIG. 3A illustrates a roof stiffener 310 that includes top cross-section 312 and web 314 and is generally shaped as a T-beam. Roof stiffeners 310 may be the frame or the backbone of the new roof.

The length of the roof stiffener web 314 is made approximately to the gauge specified by the Original Equipment Manufacturer ("OEM") to aid in its application to the railcar. In certain embodiments, roof stiffener 310 may be any suitable roof stiffener or roof beam assembly and may be T-shaped or any suitable shape. Using roof stiffeners similar to those described here may increase the likelihood of maintaining top chord parallelism and gauge. In addition, these or similar roof stiffeners may provide a structural backbone that allows a new roof to withstand and support side wall or roof loads.

FIG. 3B illustrates a cross sectional view of roof stiffener 310 and a top chord 330. Roof stiffener 310 is applied across a railcar in a section where a roof has been removed, as described in conjunction with FIG. 2. As illustrated, top cross section 312 comes into contact with a top surface of top chord 330 and web 314 comes into contact with an interior, vertical face of top chord 330. Roof stiffener 310 makes similar contact with the top chord located on the opposing side of the rail car (not illustrated).

Roof stiffener 310 is applied to a railcar at longitudinal center points of longitudinal top chords 330, similar to longitudinal center points C1 described in conjunction with FIG. 2. This application may occur by welding top cross section 312 and web 314 at their respective points of contact with longitudinal top chord 330, as illustrated. Roof stiffener 310 is welded in this manner to a rail car at both longitudinal center points.

In particular embodiments, roof stiffener 310 may be made of any suitable metal, transition metal, alloy, or composite, including for example, carbonized steel, stainless steel, or carbon fiber. In certain embodiments, top cross section 312 and web 314 may be made of different materials.

In various embodiments, application of one or more roof stiffeners 310 may require careful evaluation of top chord parallelism and gauge. Standard OEM gauge between the interior, vertical faces of longitudinal top chords 330 generally may be approximately 9'-5½". It may be useful at this point, and at various points throughout the roof conversion process, to either jack the top chords apart or pull them together in order to obtain OEM gauge. Once OEM gauge has been obtained, the longitudinal centers of both top chords may be located, and it may be helpful to mark these positions on both top chords. In various embodiments, the application of a first roof stiffener may be at this center position or may be at any other suitable position. It may be useful to mark the center of a roof stiffener at both ends and then line up the center marks on each end of the roof stiffener with the desired marks on the top chords. Positioning a roof stiffener in accordance with some or all of these steps may assist in maintaining top chord parallelism and gauge. Additionally, in particular embodiments, squaring the roof stiffener with the top chords may be beneficial for various other steps in constructing a new roof, similar to the steps described in conjunction with FIGS. 4 through 9.

To facilitate placement of roof stiffener 310, it is preferable to ensure that roof stiffener 310 is square and flush with the top surface of top chord 330 prior to welding. Roof stiffener 310 may be similarly square and flush with the opposing top chord. A straight edge may be used in various embodiments to verify appropriate placement. Once roof stiffener 310 is appropriately placed it may be welded to top chord 330 at the points of contact. Similarly, roof stiffener 310 may be welded to the opposing top chord.

In certain embodiments, some, all, or none of the welds may occur per the latest edition of American Welding Society (AWS) D15.1. In various embodiments, some, all, or none of the welds may stop generally between approximately ¼" and ½" from the edge of a joint. Additionally, in particular embodiments, some, all, or none of the welds will terminate without undercuts or craters. Welding joints in accordance with some or all of these steps may increase the integrity of various joints in a new roof.

In particular embodiments, additional roof stiffeners 310 may be applied in a similar fashion. For example, in certain embodiments, roof stiffeners 310 may be applied along longitudinal top chords 330 at approximately 5'-0" centers, working away from roof stiffener 310 positioned at the longitudinal center points.

In embodiments where the roof is removed fully, roof stiffeners 310 may be applied at approximately 5'-0" centers, working away from center roof stiffener 310 toward the respective ends of a railcar. In particular embodiments, roof stiffeners 310 may be applied with greater or lesser distance between them. In certain embodiments, roof stiffeners 310 may be applied with regular spacing, irregular spacing, or a mixture of regular and irregular spacing. In addition to promoting top chord parallelism and gauge, positioning roof stiffeners in this or a similar manner may provide an increased flexibility in attaching additional components to the roof.

In embodiments where a first section of roof is removed, for example the 15' section described in conjunction with FIG. 2, roof stiffeners 310 may be applied at approximately 5'-0" centers within the section, working away from center roof stiffener 310 toward the respective ends of a railcar. In various embodiments where a 15' section is removed initially, one roof stiffener 310 may be positioned at the longitudinal center points of top chords 330 and two roof stiffeners may be positioned at approximately 5'-0" centers on either side for a total of three roof stiffeners 310 within the 15' section shown in FIG. 2. Once roof stiffeners 310 are positioned, exposed mounting holes in top chords 330, including top chords that run along the width of a railcar, may be plug welded and ground smooth.

Figure 4A:
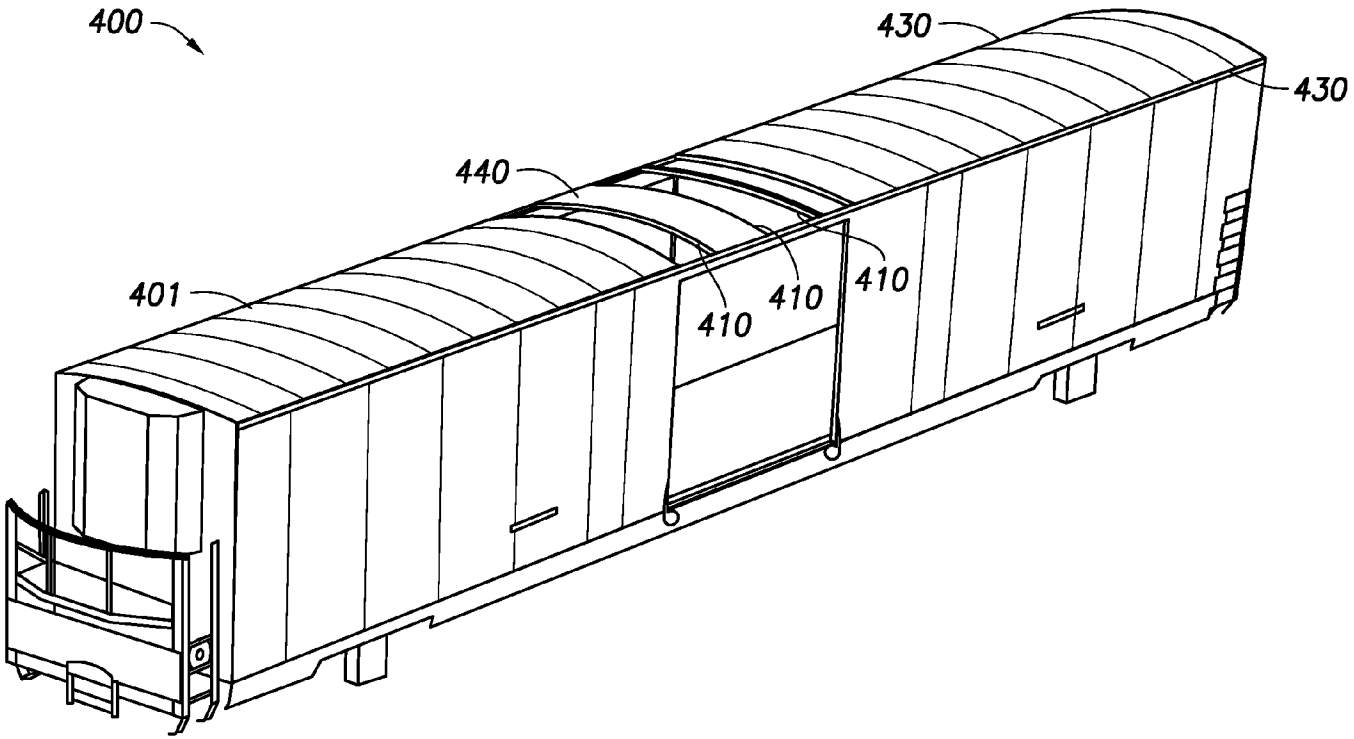
FIGS. 4A, 4B, and 4C illustrate a railcar with a corrugated roof sheet panel in accordance with particular embodiments.
Figure 4B:
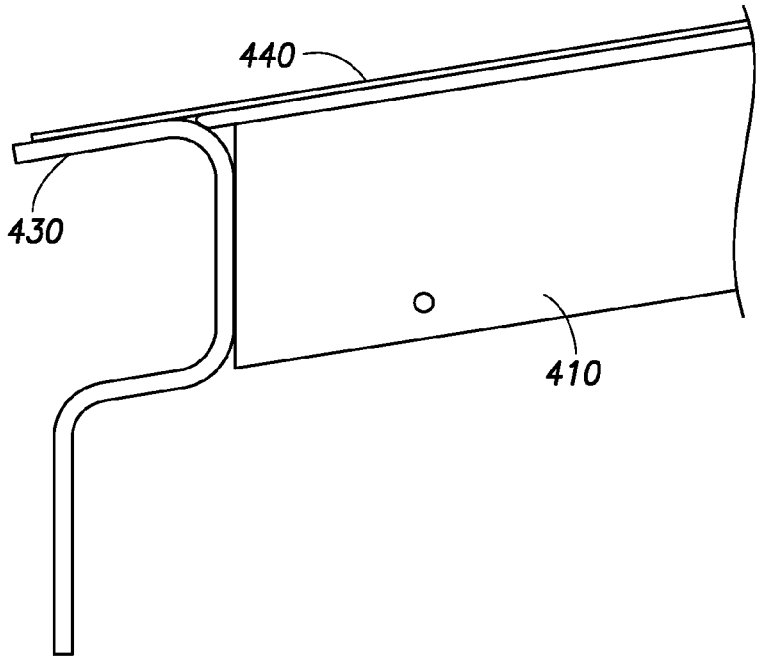
Figure 4C:
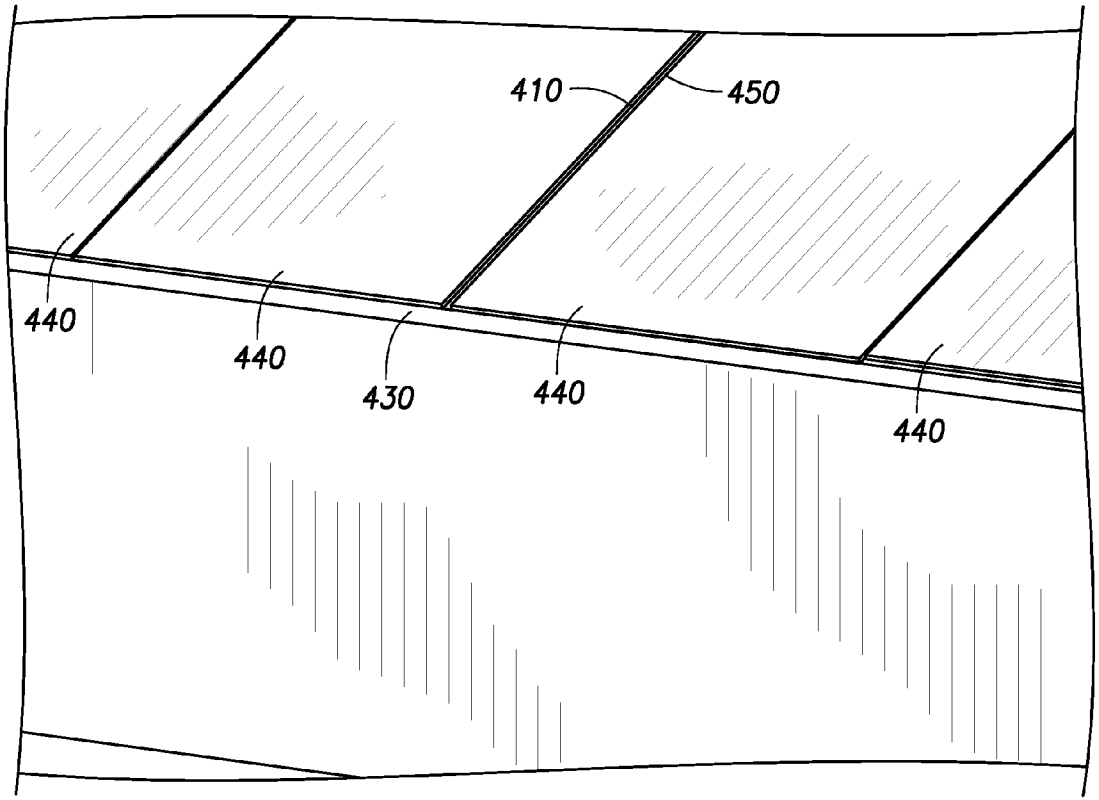

FIGS. 4A, 4B, and 4C illustrate a railcar with a corrugated roof sheet panel in accordance with particular embodiments. FIG. 4A illustrates a railcar 400 that includes a roof 401, roof stiffeners 410, longitudinal top chords 430, and a corrugated roof sheet panel 440. Corrugated roof sheet panel 440 lays flush on two roof stiffeners 410 and the upper lips of both longitudinal top chords 430.

In various embodiments, a first corrugated roof sheet panel 440 may be positioned such that it makes contact with the center most roof stiffener 410 located at the longitudinal center point of top chords 430 and an adjacent roof stiffener 410. Then a second corrugated roof sheet panel 440 (not illustrated) may be positioned such that it makes contact with center most roof stiffener 410 and another adjacent roof stiffener 410. This will cause the first and the second corrugated roof sheet panels 440 to cover a portion of the section where roof 401 has been removed. Once both corrugated roof sheet panels 440 have been positioned, they may be tack welded. In various embodiments, tack welding should occur by starting at an apex position of the corrugated roof sheet panels 440 and working toward top chords 410, such that welds are made along underlying roof stiffeners 410. Once corrugated roof sheet panels 440 are tack welded to roof stiffeners, the panels may also be tack welded to longitudinal top chords 430.

In particular embodiments, corrugated roof sheet panels 440 may be tack welded section by section. For example, once corrugated roof sheet panels 440 are applied and tack welded in a first section that includes the longitudinal center points, a second section of roof 401 may be removed in a process similar to that described in conjunction with FIG. 2. Additional roof stiffeners 410 may be applied in the second section in a process similar to that described in conjunction with FIG. 3. Then additional corrugated roof sheet panels 440 may be applied as described herein. These steps may be repeated section by section until roof 401 has been fully removed. In particular embodiments, some or all sections may be approximately 15' in length. In embodiments where roof 401 is removed in sections, final welding may be postponed until all corrugated roof sheet panels 440 are in place. Postponing final welding until all corrugated roof sheet panels 440 are tack welded may prevent twisting or deformation of one or more roof stiffeners 410 and/or corrugated roof sheet panels 440. In various embodiments, final welding may be performed so as to minimize the weld bead size. For example, a weld bead size of 3/16" or less may be used, including for example a weld bead size of ⅛".

FIG. 4B illustrates a cross sectional view of roof stiffener 410, longitudinal top chord 430, and corrugated roof sheet panel 440. Corrugated roof sheet panel 440 is sized to extend far enough over the top surface of longitudinal top chord 430 to cover any existing bolt or mounting holes that may remain from a previously removed roof, similar to those described in conjunction with FIGS. 1, 2, and 3, or that may exist for any other reason. In various embodiments, the corrugated roof sheet panel may be sized to any suitable size.

In various embodiments, the corrugated roof sheet panel 440 may extend over or overhang longitudinal top chords 430 approximately equal amounts on both sides of a railcar. In certain embodiments, the corrugated roof sheet panel may not extend far enough to sufficiently overlap longitudinal top chords 430. In these instances, a corrugated roof sheet panel may have an extension welded to one end, including for example a piece of similarly corrugated roof sheet paneling of approximately the same width that is welded to roof sheet panel 440 so as to increase the total length of corrugated roof sheet panel 440. If adjacent corrugated roof sheet panels 440 both include extensions, the sheet panels 440 may be alternated such that the extension portion of each corrugated roof sheet panel 440 is in contact with opposing top chords 430.

FIG. 4C illustrates railcar 400, roof stiffener 410, longitudinal top chord 430, corrugated roof sheet panels 440, and a gap 450. As discussed in conjunction with FIGS. 4A and 4B, corrugated roof sheet panels 440 lie flush on roof stiffeners 410 and longitudinal top chords 430. Corrugated roof sheet panels 440 are positioned in such a way that gap 450 is created between panels.

When corrugated roof sheet panels 440 are ready for final welding, gap 450 allows for a root opening in preparation for a butt weld. Roof stiffener 410 (visible through gap 450, between corrugated roof sheet panels 440) and the upper lips of longitudinal top chords 430 may serve as back-up bars for full penetration welds. In various embodiments, gaps may be left between none, certain, or all corrugated roof sheet panels and butt welds may be used between none, certain, or all corrugated roof sheet panels. In certain embodiments, full penetration welds may be used between none, certain, or all corrugated roof sheet panels. In some embodiments roof sheet panels could be separated by any particular gap. In some cases where there is a gap 450 between roof sheet panels, one or more fillet welds may be used between each panel and the underlying roof stiffener or top chord.

In various embodiments, the corrugations of each corrugated roof sheet panel may be oriented such that they run parallel or perpendicular to longitudinal top chords 430. In certain embodiments, the roof sheet panels may not be corrugated. In various embodiments, the corrugated roof sheet panels may comprise steel or any suitable material. In particular embodiments, the portion of the corrugated roof sheet panels overlapping the upper lips of each longitudinal top chord will be generally equivalent. In various embodiments, the corrugated roof sheet panels may be all similarly sized or may be of varied sized. When the corrugated roof sheet panels vary in size or when the panels are not of a length sufficient to span from one longitudinal top chord to the other, the roof sheets may have extensions welded to one end. As mentioned previously, in embodiments with roof sheet panel extensions, it may be advisable to configure panels such that an extension-portion is placed in contact with a longitudinal top chord between non-extension-portions of neighboring roof sheet panels. In various embodiments, where the corrugated roof sheet panels are welded together, welded to the railcar, or welded both together and to the railcar, it may be beneficial to apply any transverse welds first, followed by the perimeter welds. Using corrugated roof sheets in this way or in similar ways may strengthen the point of attachment between the corrugated roof sheet panels and the roof stiffeners and top chords. Additionally, these steps may increase the overall strength, structural integrity, and functionality of a new roof.

Once corrugated roof sheet panels span the top of the railcar and are welded into place, the corrugated roof sheet panels and their welds may be inspected for any defects. In certain embodiments, any weld repair may be performed at this point, prior to proceeding with any of the following steps. Additionally, once the corrugated roof sheet panels are positioned so as to form a roof, the railcar body may be placed back on its trucks and the car may be moved if required.

Figure 5A:
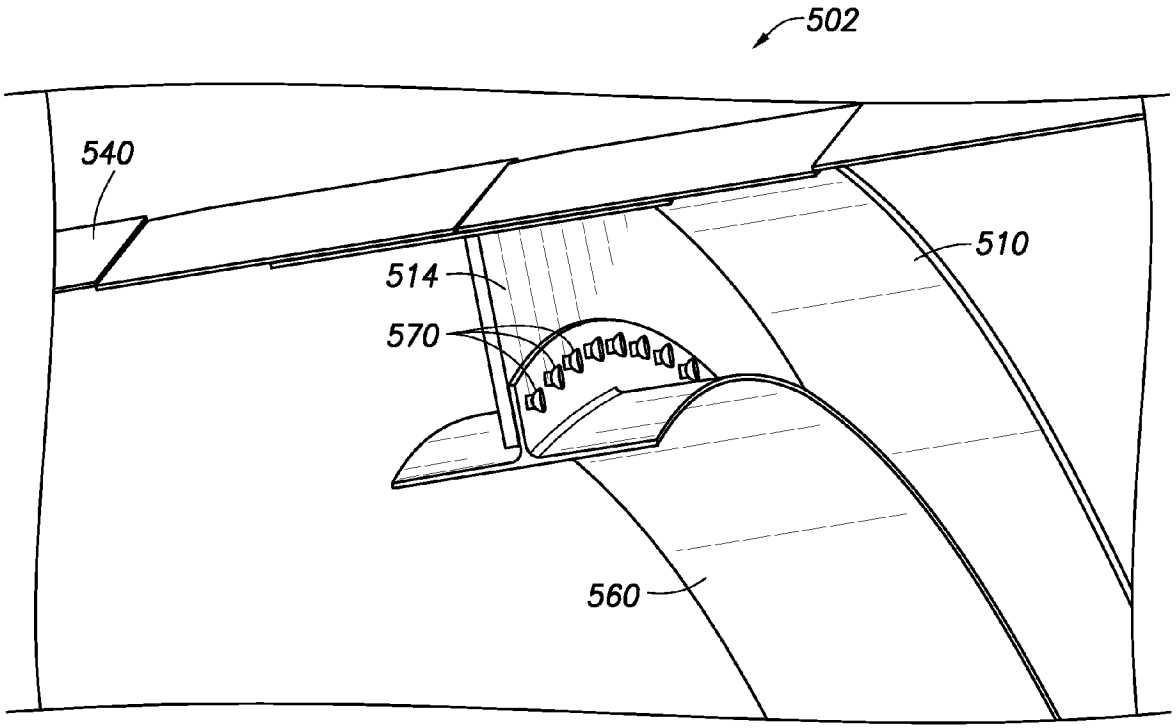
FIGS. 5A and 5B illustrate an interior view of a railcar roof in accordance with particular embodiments.
Figure 5B:
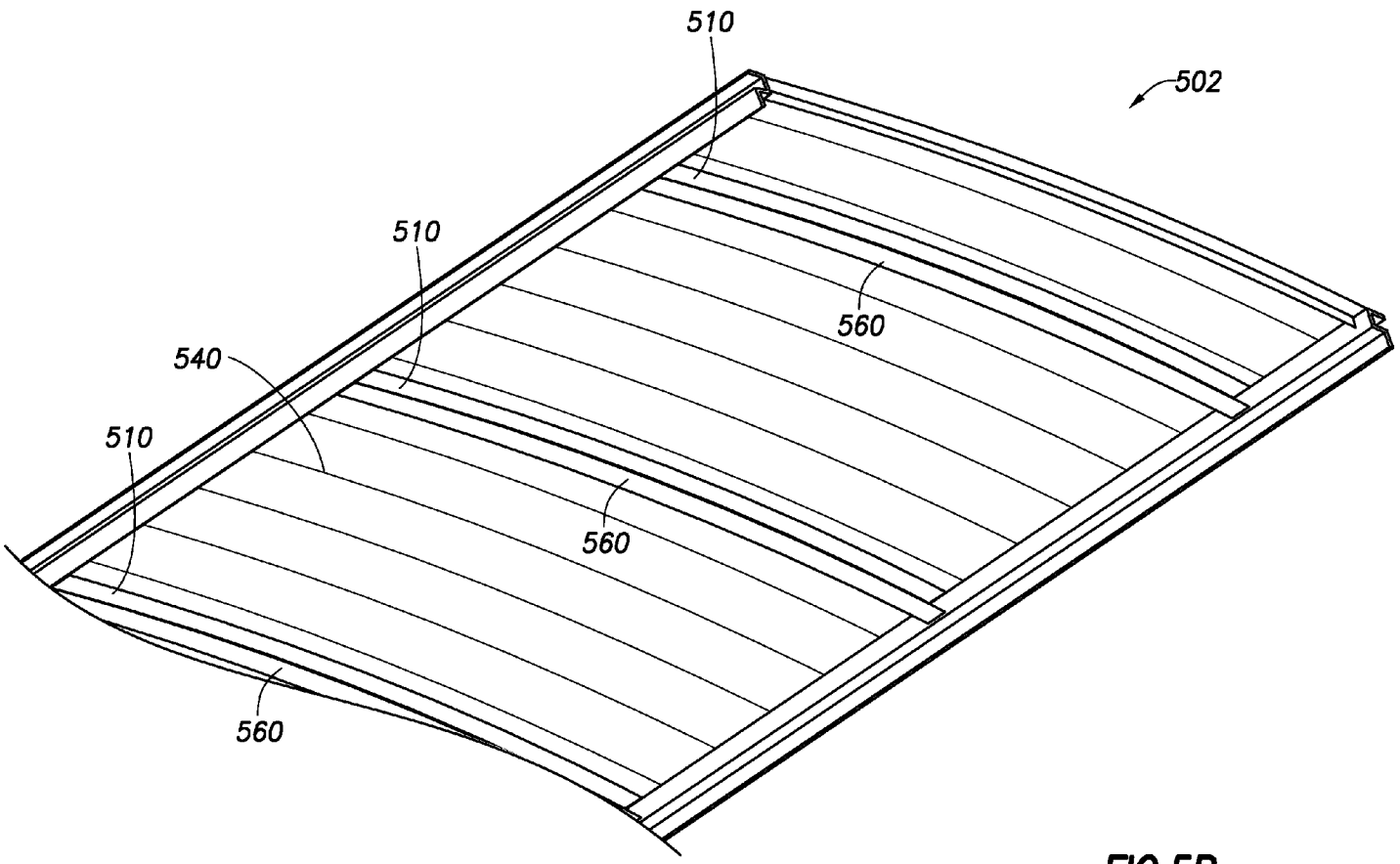

FIGS. 5A and 5B illustrate an interior view of a railcar roof in accordance with particular embodiments. FIG. 5A illustrates a newly constructed roof 502, roof stiffener 510, corrugated roof sheet panel 540, "T" section pultrusions 560, and pop rivets 570. Roof stiffeners 510 includes web 514 and pre-drilled holes. "T" section pultrusions 560 comprise a fiber reinforced polymer and three pre-drilled holes. In certain embodiments, "T" section pultrusion 560, which may also be known as a composite hanger, may include any suitable number of pre-drilled holes.

A "T" section pultrusion 560 is applied to a web 514 by aligning, for proper centering, "T" section pultrusion 560's three pre-drilled holes with web 514's pre-drilled holes and applying three pop rivets 570. The remaining pre-drilled holes in web 514 may be used as a template to drill the required holes into "T" section pultrusion 560; this may be done at a 1" lap distance using a 9/32" drill bit. Pop rivets 570 may be applied to each completed hole, as illustrated. In particular embodiments, pop rivets should be pulled through from the side of "T" section pultrusion 560.

In certain embodiments, a "T" section pultrusion may comprise any composite or metal, or any suitable material and may include none, one, two, three or more pre-drilled holes for initial application and proper centering on a roof stiffener web. In various embodiments, a "T" section pultrusion may function as both a hanger and an insulator. Utilizing "T" section pultrusions in this manner may increase the versatility of the roof and flexibility in attaching further components to the roof.

FIG. 5B illustrates an interior view of a portion of newly constructed roof 502. This view roof stiffeners 510, "T" section pultrusions 560, top chords 530, and the underside of corrugated roof panels 540. Once a "T" section pultrusion 560 is coupled to a roof stiffener 520, a formation similar to an I-beam is created and runs between top chords 530 across a railcar.

Figure 6:
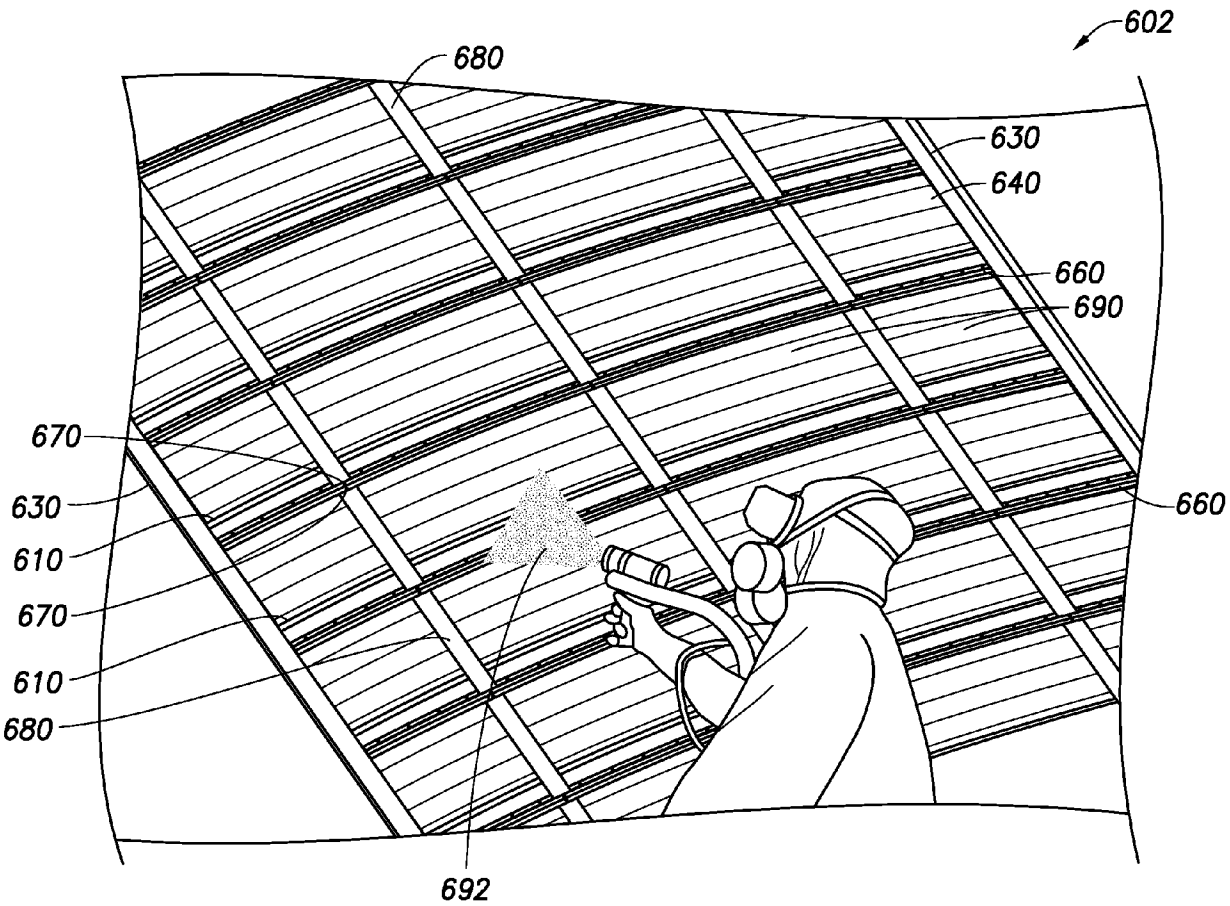
FIG. 6 illustrates another interior view of a railcar roof in accordance with particular embodiments.

FIG. 6 illustrates another interior view of a railcar roof in accordance with particular embodiments. Roof 602 comprises roof stiffeners 610, longitudinal top chords 630, roof panels 640, "T" section pultrusions 660, pop rivets 670, and angles 680.

Angles 680 are applied to "T" section pultrusions 660 so as to create three rows that run approximately the full length of the roof, generally parallel to longitudinal top chords 630, and generally perpendicular to "T" section pultrusions 660. Angles 680 are applied to a "T" section pultrusion 660 by drilling a hole at each end of an angle 680; this may be done by using a 9/32" drill bit. In certain embodiments, any suitably sized drill bit may be used, including, for example, a Size F (0.257") drill bit. Pop rivets 670 are applied to each completed hole.

In various embodiments, angles may be positioned at regular or irregular spacing between longitudinal top chords or at any spacing appropriate to supporting the application of a plenum panel. Proper positioning of the angles may be important to the functionality of the roof, for example proper positioning of the angles may allow for the application of plenum panels that may support refrigeration of a railcar. Thus, it may be helpful to use a chalk line to mark the appropriate positions for the angles down the full length of the railcar. In various embodiments, the angles may comprise aluminum, any composite or metal, or suitable material. Applying angles as described herein may improve the ability of a roof to employ plenum panels in any variety of desired configurations.

Roof panels 640, roof stiffeners 610, "T" section pultrusions 660, and angles 680 together create foaming cavities 690. Foam insulation 692 will be sprayed into foaming cavities 690 from below roof 602. Foam insulation 692, which may comprise a urethane foam, may be sprayed into the foaming cavities 690 to an overall thickness of 4'-¼", a depth that may make insulating foam 692 approximately flush with "T" section pultrusions 660.

In certain embodiments, foam insulation 692 may additionally or alternately be injected into cavities 690. For example, in various embodiments, foam insulation 692 may be injected after the application of the interior roof panels as described in conjunction with FIGS. 7A and 7B, or at any suitable time during the construction of roof 602. In particular embodiments, foam insulation 692 may be core foam and may be injected in a process referred to as core foaming.

Additionally, in particular embodiments, insulating foam 692 may be applied to the interface between the roof and railcar side wall to a thickness flush with the inside surface of the wall sheet. Any excess ceiling foam may be shaved flush with the bottom surface of the composite hanger and any excess corner foam may be shaved flush with the surface of the side wall. In particular embodiments, foam 692 may be any foam of suitable insulating properties and may be applied in any suitable manner. In various embodiments, foam 692 may be applied to any appropriate depth to provide the desired insulation effect. Utilizing insulation foam may improve the ability of a railcar to maintain temperatures during refrigeration and, therefore, in addition, possibly to improve energy efficiency. Proper application of the insulating foam may also decrease hot spots or uneven temperature profiles within a railcar.

In certain embodiments, the ambient air temperature and railcar body temperature may be maintained at a minimum of 70 degrees Fahrenheit throughout the spraying and curing process to improve the application process. Further, it may be helpful to have a qualified technician apply the insulating foam using recommended equipment as specified by a foam supplier, or other suitable equipment.

Figure 7A:
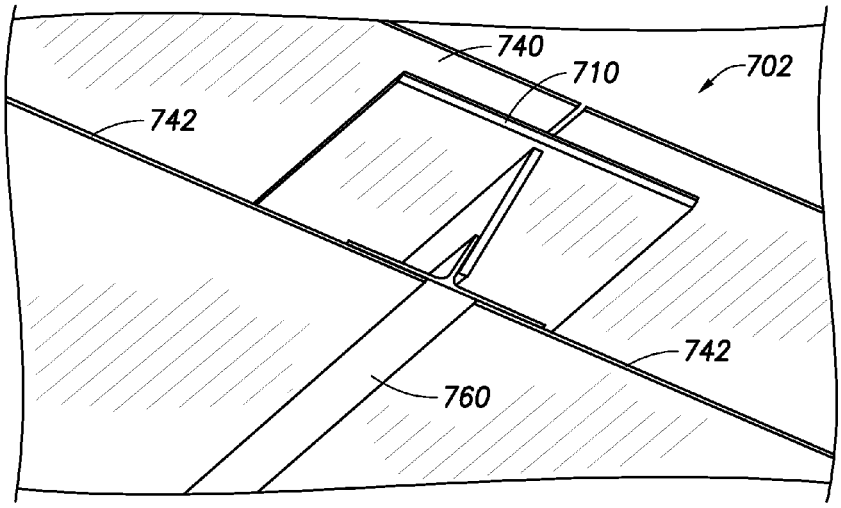
FIGS. 7A and 7B illustrate another interior view of a railcar roof in accordance with particular embodiments.
Figure 7B:
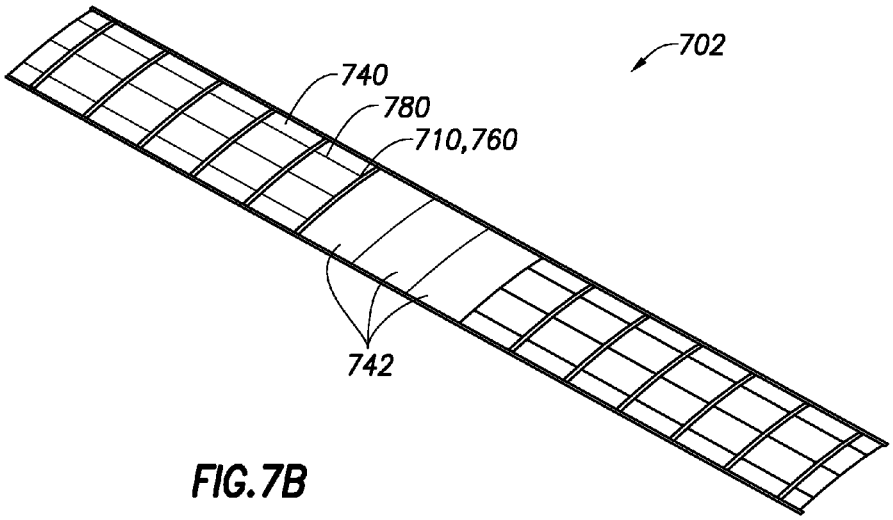

FIGS. 7A and 7B illustrate another interior view of a railcar roof in accordance with particular embodiments. FIG. 7A illustrates a portion of a newly constructed roof 702 that includes a roof stiffener 710, corrugated roof sheet panels 740, interior roof panels 742, "T" section pultrusions 760, and angles 780. Foam insulation that may be present in various embodiments is not illustrated in this view. Certain embodiments may also include components not illustrated here including, for example, foam insulation, adhesive, self-tapping counter sinking screws, and edge and corner trim pieces.

Interior roof panels 742 may include a fiber reinforced polymer and a gel surface. Interior roof panels 742 is applied such that its gel surface is exposed to the interior environment of a railcar and that it overlaps adjacent "T" section pultrusions 660 by approximately 1½" each. Interior roof panels 742 may be secured using adhesive and self-tapping counter sinking screws. Adhesive may be applied to the side of interior roof panel 742 facing corrugated steel roof panels 740 and not exposed to the environment; it may be applied around the perimeter of the panel and across the center using a large cross-hatch design.

FIG. 7B illustrates roof 702, roof stiffeners 710 and "T" section pultrusions 760, corrugated roof sheet panels 740, interior roof panels 742, and angles 780. In addition to adhesion, interior roof panels 742 may be secured by applying three self-tapping counter sinking screws through the panel and into each of the underlying angles 780. Along each angle 780, one screw may be placed at the center of interior roof panel 742 and one at each edge of interior roof panel 742, with an effort to avoid any previously placed pop rivets, similar to those placed in accordance with the steps described in conjunction with FIG. 6.

In various embodiments, additional support for interior roof panels 742 may be provided by drilling holes and applying pop rivets along an edge or edges where interior roof panels 742 overlap T section pultrusions 760. Any suitably sized drill bit may be used, including, for example, a Size F bit (0.257"). In various embodiments, any pop rivet may be used, including, for example ¼" pop rivets. In certain embodiments, holes may be drilled approximately ¾" from the end of interior roof panels 742 and may be approximately 12" apart.

To aid in positioning, it may be helpful in various embodiments to strike a chalk line running approximately the full length of a railcar to indicate the position of the angles and also to mark the center line of each interior roof panel 742. In particular embodiments, interior roof panel 742 may comprise any composite or metal, or any suitable material. In certain embodiments, any suitable number of screws may be used to apply interior roof panel 742 and the screws may be self-tapping counter sinking screws or any suitable fasteners. Similarly, in various embodiments, the adhesive may be a caulk adhesive, double sided tape, or any material with suitable adhesion properties.

Applying interior roof panels 742 in this manner may serve to protect the underlying insulation foam, resulting in constant or improved temperature control properties. Additionally, interior roof panels 742 may increase the overall stability of a roof and may allow for greater flexibility in attaching addition components.

In particular embodiments, interior roof panels 742 may be applied by starting at the center line of the railcar and working toward each end, such that interior roof panels 742 extend approximately the full length of a railcar. After all interior roof panels 742 are in place, edge and corner trim pieces may be applied using adhesive and truss head screws. Once edge and corner trim pieces are applied, white TREMCO caulk may be applied to the edges of all interior roof panels 742 and trim pieces.

In some embodiments, the edge and corner trim pieces may be, in full or in part, the edge trim, corner trim, or both, removed in conjunction with the removal of the one-piece composite roof, similar to the steps described in conjunction with FIG. 2. In these instances, any location identifying marks applied during removal may be useful. In various embodiments, the interior trim pieces may be applied using any suitable adhesive, any suitable fasteners, or both, in any suitable configuration. Additionally, as required, additional foaming may be performed to fill voids and cavities in railcar corners. In certain embodiments, any caulk applied may be white TREMCO caulk or any suitable caulk. These steps individually or together may prevent moisture from entering the interior portions of the roof, or may improve the structural integrity of the roof, or both. Moreover, reusing components may serve to improve various economic and environmental indicators associated with constructing a new roof.

Figure 8A:
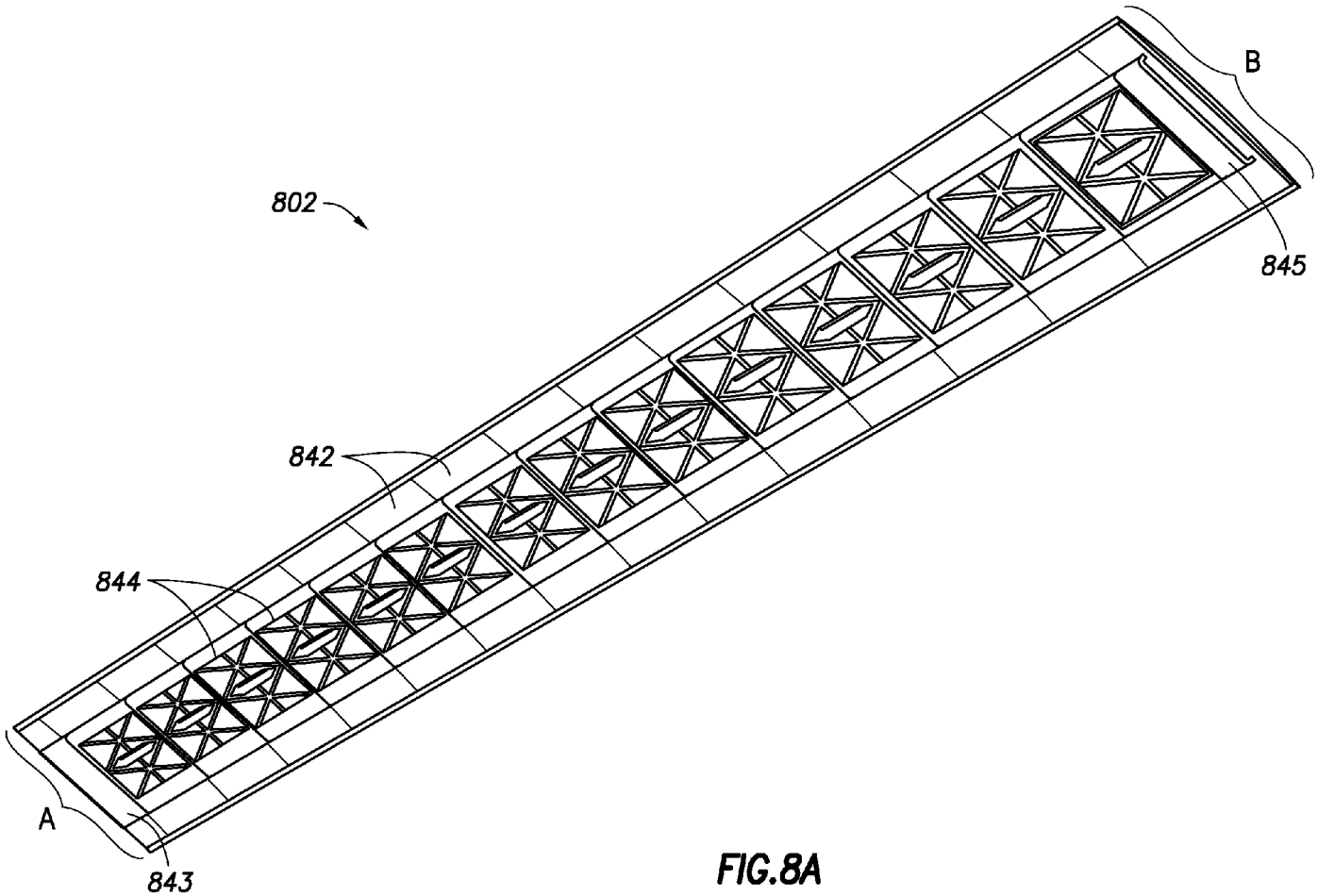
FIGS. 8A and 8B illustrate another interior view of a railcar roof in accordance with particular embodiments.
Figure 8B:
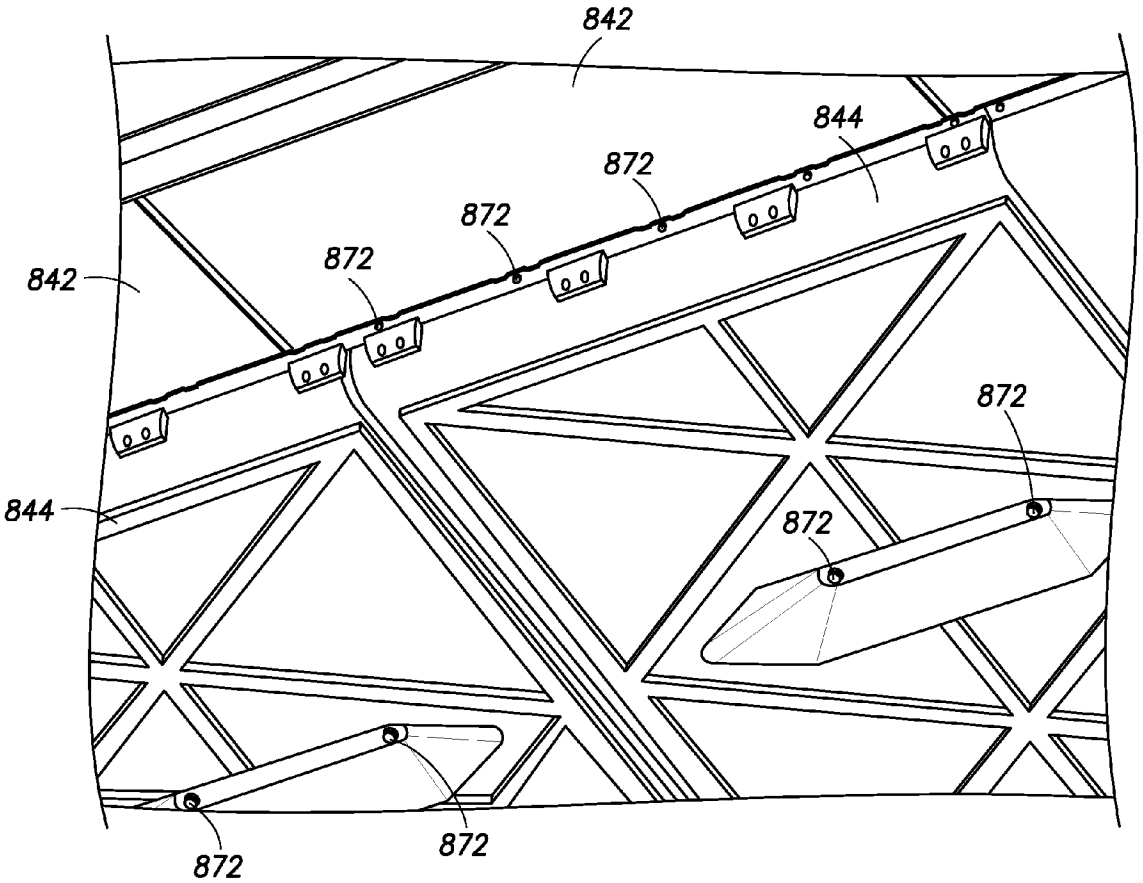

FIGS. 8A and 8B illustrate another interior view of a railcar roof in accordance with particular embodiments. FIG. 8A illustrates a newly constructed roof 802, interior roof panels 842, a plenum transition 843, plenum panels 844, a plenum transition 845, an end A, and an end B.

A first plenum panel 844 is applied at end A, where end A of the railcar is the end with the attached refrigeration unit. Located between the first plenum panel 844 and end A is plenum transition 843. This initial plenum panel 844 is applied to the angles (not illustrated) located under interior roof panels 842, where the configuration of angles and interior roof panels may be similar to the configuration discussed in conjunction with FIGS. 7A and 7B.

Once a first plenum panel 844 is secured, a second plenum panel 844 is applied, such that the second plenum panel 844 overlaps the first plenum panel 844 on the portion of the first plenum panel closest to end B. This application process continues from end A toward end B, such that plenum panels 844 overlap adjacent plenum panel 844, Between the final plenum panel 844 and end B, plenum transition 843 is applied.

FIG. 8B illustrates a portion of roof 802 with plenum panels 844 and includes interior roof panels 842, and self driving stainless steel screws 872. Plenum panels 844 are applied to the angles (not illustrated) underlying interior roof panels 842 using self driving stainless steel screws 872, where the configuration of angles and interior roof panels may be similar to the configuration discussed in conjunction with FIG. 6. Self driving stainless steel screws 872 are applied at each edge and in the middle of plenum panels 844. Additionally, sealant tape may be applied at the point of overlap between each plenum panel 844. In various embodiments, additional fasteners, such as bolts and washers may also be utilized to apply plenum panels 844 to roof 802.

Plenum panels 844 may, in certain embodiments, change or enhance the performance characteristics of a railcar. Plenum panels 844 may have thermal characteristics that improve the ability to change or maintain a desired temperature within a railcar, including the ability to heat, ventilate, or cool the railcar. For example, by coupling plenum panels 844 to a refrigeration unit through plenum transition 843, plenum panels 844 may improve the ability to cool or maintain a desired temperature in a railcar. In particular embodiments, the circulation of air controlled for temperature, humidity, or other characteristics, may be aided by the presence of plenum panels 844.

In various embodiments, plenum panels may be any size or shape suitable for the desired purpose. In certain embodiments, some, all, or none of the plenum panels may be new and some, all, or none of the panels may be reused panels, similar to the panels described in conjunction with FIG. 2. In particular embodiments, various fasteners, sealant tape, or both may be used to apply any, some, or all of the plenum panels. In embodiments where fasteners are used, the fasteners may comprise self driving stainless steel screws, washers, bolts, or any appropriate fasteners. Properly applying plenum panels may improve refrigeration performance, while reusing plenum panels may improve various costs associated with constructing a new roof.

FIG. 9 illustrates a portion of a railcar in accordance with particular embodiments. Railcar 900 comprises a newly constructed roof 902 and a refrigeration unit 905. Roof 902 includes interior roof panels 942, plenum panels 944, and plenum transition 945, as well as various other materials similar to and configured in a similar manner to those described in conjunction with FIGS. 2-8.

After roof 902 is constructed, additional steps may be appropriate to prepare railcar 900 for commercial use. In certain embodiments, this may include evaluating various performance characteristics of railcar 900 with roof 902 and updating markings on railcar 900 accordingly. For example, in particular embodiments, a "DO NOT LOAD ABOVE THIS LINE WITHOUT RECALCULATING CENTER OF GRAVITY" red line stenciled in the interior of certain railcars may be re-located. Often the OEM height for this red line may be approximately 11'-9" above the floor. Following construction of roof 902, this red line may be lowered 2" to a new height of 11'-7" above the floor. In addition, a "Empty CG Above Rail" number stenciled on one or more exterior corners of railcar 900 may be changed. Often the original number may be 65. Following construction of roof 902, this number may be changed to an appropriate number, for example, to 69. In certain embodiments, following construction of roof 902, railcar 900 may be weighed. "Lightweight" and "Load Limit" stencil information may be updated accordingly, and may be updated in accordance with the American Association of Railroads Field Manual or other advisory materials.

Further, in certain embodiments, various components may be repositioned or removed after construction of roof 902. For example, there may be two fall arrest anchors or eye bolts at the end of railcar 900 with refrigeration unit 905 in the end chord. These anchors may be removed and inserted near the end of the longitudinal top chords of railcar 900. In various embodiments, a hole may be drilled or created through a pierce and ream process and may have a diameter of approximately 11/16". In certain embodiments, the holes may be located approximately 1.125" from the end edge of the longitudinal top chords and 1.125" from the bottom edge of the longitudinal top chords. In embodiments where the anchors appear to be worn or damaged, they may be replaced. In some embodiments, the anchors may be discarded and anchor plates may be applied near the end of longitudinal top chords of railcar 900. In various embodiments, any suitable hardware may be applied at or near the end of longitudinal top chords to provide structural support.

Once construction of roof 902 is complete, roof 902, and the longitudinal top chords and end chords may be cleaned through a cleaning process, such as a SSPC-SP6 Commercial Blast or any process suitable to reduce or remove dirt, grease, oil, or other foreign matter. In particular embodiments, roof 902, the longitudinal top chords, and end chords may receive a coating, such as white epoxy or polyurethane roof paint. For example, railcar 900 may be coated with a particular urethane or any equivalent coating, which may provide quick curing of the roof and various other technical advantages.

In various embodiments, roof 902 may replace an existing railcar roof, which may reduce or eliminate expenditures associated with fixing an old and/or damaged roof. In certain embodiments, roof 902 may be constructed on a new railcar in a process similar to the steps described in FIGS. 2-8. When roof 902 is constructed on a new rail car some modifications may be made. For example, different or additional provisions may be made to ensure that the railcar maintains the proper gauge. Providing roof 902 on a new rail car may allow for a reduction in maintenance costs and/or operating costs.

Figure 10:
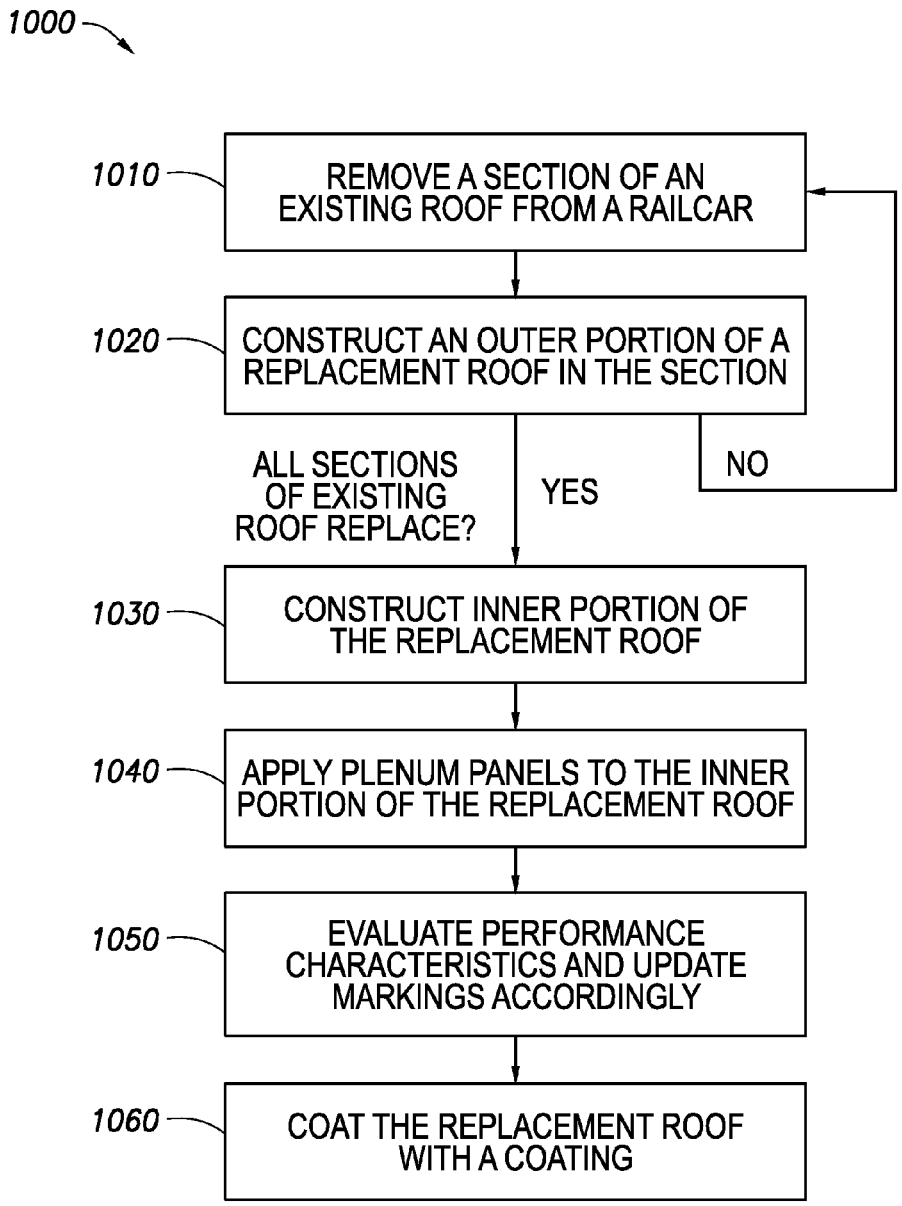
FIG. 10 illustrates a method for removing and replacing a railcar roof in accordance with particular embodiments.

FIG. 10 illustrates a method for removing and replacing a railcar roof in accordance with particular embodiments. Method 1000 begins with step 1010 which includes removing a section of an existing roof from a railcar. In particular embodiments, the existing roof may be a composite roof that may have been damaged or may have degraded over time. The section removed may measure approximately 15' in length and may be removed from the center of the existing roof such that the section measures 7'-6" from a center point toward each end.

In step 1020, an outer portion of a replacement roof is constructed in the section where the existing roof has been removed. The outer portion of the replacement roof may include one or more roof stiffeners or beams. In various embodiments, these beams may be spaced at approximately 5" centers, thus allowing for three beams within the removed section. The beams may transverse the railcar and may be coupled to longitudinal top chords of the railcar. Once the beams are in place, one or more corrugated roof sheet panels may be overlaid so as to create an exterior shell. The corrugated roof sheet panels may be tack welded in place until all sections of the existing roof have been removed and replaced.

Steps 1010 and 1020 are repeated iteratively until all sections of the existing roof have been removed and replaced with the outer portion of the replacement roof. Once all corrugated roof sheet panels of the replacement roof are in place, the panels may be permanently welded to the underlying beams and longitudinal top chords. Panels adjacent to the ends of the railcar may be permanently welded to the adjacent end chords.

In step 1030, an inner portion of the replacement roof is constructed. The inner portion roof may be include one or more interior roof panels that are coupled to the frame of the outer portion of the replacement roof. The interior roof panels may be coupled to the outer portion through adhesion, various fasteners, and/or any suitable means. In particular embodiments, insulation may be applied between the outer and inner portions of the replacement roof and may be applied before the interior roof panels are coupled. In various embodiments, the inner portion of the roof may supplement or augment the frame by applying a secondary set of beams or angles. These angles may improve the structural integrity of the roof and may better facilitate coupling plenum panels to the roof as described in the next step.

In step 1040, plenum panels are applied to the inner portion of the replacement roof. Plenum panels may be coupled to the inner portion of the replacement roof through fasteners or any suitable means. Plenum panels may be configured in such a way as to facilitate or aid the circulation of temperature or humidity controlled air in the railcar. In particular embodiments, plenum panels may be coupled to a refrigeration unit inside or outside the railcar.

In step 1050, one or more performance characteristics of the railcar and newly constructed roof are evaluated. If necessary, the markings on the railcar may be updated in accordance with the evaluation or evaluations. For example, in particular embodiments, certain loads may necessitate the calculation of the center of gravity of the railcar. Related cautionary warnings stenciled inside the railcar may need be to modified as a result of the newly constructed roof.

In step 1060, the newly constructed roof and portions of the railcar may be coated with a coating, such as white epoxy or polyurethane roof paint. In particular embodiments, the roof may be treated with a variety of other substances, including substances designed to improve the performance and/or extend the life of the replacement roof.

In various embodiments, method 1000 may include other or additional steps. In particular embodiments, the identified steps of method 1000 may be altered or omitted. For example, in certain embodiments, step 1010 may include removing all sections of the existing composite roof simultaneously. As another example, step 1060 may be omitted.

Technical advantages of particular embodiments may include providing a long term and cost effective solution to continuously having to repair damaged composite roofs. An additional technical advantage of certain embodiments is a roof that may be much easier to repair. A technical advantage of various embodiments is a roof that may provide the structural integrity and repair-ability of steel. An additional technical advantage of particular embodiments is the application to earlier generation refrigerated railcars of a roof similar in design to roofs used on later generation railcars. Another technical advantage of certain embodiments is the adaptability of the roof to employ the ThermoKing modular plenum system. An additional technical advantage of various embodiments is the ability to fabricate the roof on the car body without requiring special fixturing, molds, or handling. Further technical advantages will be readily apparent to one of ordinary skill in the art. Moreover, while specific advantages have been enumerated above, various embodiments may include all, some, or none of the enumerated or apparent advantages.

Although the present disclosure has been described in detail with reference to particular embodiments, it should be understood that various other changes, substitutions, and alterations may be made hereto without departing from the spirit and cope of the present invention. For example, although particular embodiments of the disclosure have been described with reference to a number of elements included in a refrigerated railcar cover, these elements may be combined, rearranged or positioned in order to accommodate particular railcar roof needs. Various embodiments contemplate great flexibility in the arrangement and construction of the roof. Additionally, while certain embodiments are described with respect to a refrigerated railcar roof, particular embodiments may be used as a roof for a variety of railcars or other structures capable of transporting refrigerated and non-refrigerated goods.

What is claimed is:

1. A method comprising:

removing a roof from a railcar, the railcar comprising a plurality of top chords;

coupling an outer portion of a replacement roof to one or more of the plurality of top chords, the outer portion comprising a frame and a first plurality of panels; and coupling an inner portion of the replacement roof to the frame of the outer portion of the replacement roof after coupling the outer portion to one or more of the plurality of top chords, the inner portion comprising a second plurality of panels.

2. The method of claim 1, further comprising coupling a third plurality of panels to the second plurality of panels, the third plurality of panels configured to assist with temperature control within the railcar.

3. The method of claim 1, wherein the frame comprises a plurality of beams.

4. The method of claim 1, further comprising applying insulation between the outer portion and the inner portion of the replacement roof.

5. The method of claim 1, wherein removing the roof from the railcar comprises removing one or more pieces of interior trim.

6. The method of claim 5, wherein the inner portion of the replacement roof comprises one or more pieces of interior trim removed during removal of the roof from the railcar.

7. The method of claim 1, further comprising coating the replacement roof with a coating after coupling the outer portion and inner portion of the replacement roof.

8. A method for constructing a railcar roof comprising:

coupling an outer portion of a railcar roof to one or more of a plurality of top chords of a railcar, the outer portion comprising a frame and a first plurality of panels; and coupling an inner portion of the railcar roof to the frame of the outer portion of the railcar roof after coupling the outer portion to one or more of the plurality of top chords, the inner portion comprising a second plurality of panels.

9. The method of claim 8, further comprising coupling a third plurality of panels to the second plurality of panels, the third plurality of panels operable to assist with temperature control within the railcar.

10. The method of claim 8, wherein the frame comprises a plurality of beams.

11. The method of claim 8, further comprising applying insulation between the outer portion and the inner portion of the railcar roof.

* * * * *